US006113243A

United States Patent [19]

Saul

[11] Patent Number: 6,113,243

[45] Date of Patent: Sep. 5, 2000

[54] DRIVER INFORMATION LIGHTS

[76] Inventor: James D. Saul, 1225 Carvell Dr., Winter Park, Fla. 32792

[21] Appl. No.: 09/100,924

[22] Filed: Jun. 19, 1998

[51] Int. Cl.[7] ..... F21L 15/14

[52] U.S. Cl. ..... 362/105; 362/276; 362/802; 345/8

[58] Field of Search ..... 362/105, 106, 362/800, 802, 276, 464; 340/438, 461, 462, 9, 980; 345/8; 2/422

[56] References Cited

U.S. PATENT DOCUMENTS

| | | | |
|---|---|---|---|
| 4,722,101 | 2/1988 | Blower | 2/422 |
| 4,891,736 | 1/1990 | Gouda | 362/105 |
| 4,911,737 | 3/1990 | Yehl et al. | 55/2 |
| 5,072,209 | 12/1991 | Hori et al. | 340/432 |
| 5,083,246 | 1/1992 | Lambert | 362/62 |
| 5,207,500 | 5/1993 | Rios et al. | 362/105 |
| 5,327,587 | 7/1994 | Hurwitz | 2/422 |
| 5,408,393 | 4/1995 | Becker | 362/105 |
| 5,486,821 | 1/1996 | Steven et al. | 340/970 |
| 5,525,989 | 6/1996 | Holt | 342/20 |
| 5,544,027 | 8/1996 | Orsano | 362/105 |
| 5,612,708 | 3/1997 | Ansley et al. | 345/8 |
| 5,916,292 | 6/1999 | Issa et al. | 701/62 |

*Primary Examiner*—Sandra O'Shea
*Assistant Examiner*—Ali Alavi
*Attorney, Agent, or Firm*—Law Offices of Brian S. Steinberger; Brain S. Steinberger

[57] ABSTRACT

A light emitting attachment device for driver helmets that visibly indicates to the driver selected vehicle conditions on a race car and a motorcycle. The helmet has a visor with a clear flexible tube supporting an array of single colored LEDs clamped inside the visor. The helmet is plugged into an shift indicator rpm light on the vehicle. When the shift indicator switch turns on, the LEDs all light up indicating to the driver when to shift the vehicle into another gear. The device can also be attached to dash board warning lights such as those for engine temperature, oil pressure, and the like. When the dash warning light comes on, the LEDs light up on the visor indicating to the driver the warning condition. The LED array can include a first set of LEDs (such as yellow ones) dedicated to being activated when the shift light comes on and a second set of LEDs (such as red) that turn on when an engine warning condition exists.

20 Claims, 5 Drawing Sheets

DRIVER INFORMATION LIGHTS

This invention relates to helmet indicator lights, and in particular to a helmet device for visibly indicating to the driver when a shift indicator switch and a warning light on the vehicle has activated.

BACKGROUND AND PRIOR ART

It is popular for race car drivers to use helmets with visors for protection. Both before a race and during a race, the driver must constantly be monitoring dash board gauges below their windshield in the car cockpit such as the warning lights for oil pressure, engine temperature, pressure sensors, and the like. For example, if a red oil light goes on, the driver must immediately shut down the car. Similarly, the driver must be cognizant of when engine temperature, and other engine type sensor warning lights turn on. Furthermore, the race driver generally relies on a standard rpm (revolutions per minute) shift light that turns on as the driver is revving the engine, which tells the driver when to shift gears. The typical helmet with attached visor when worn gives the driver a limited field of sight making it difficult for the driver to both concentrate on the race and look down to monitor the warning gauges and the (rpm switch) shift indicator lights. Similar problems exist for motorcycle racers who also use helmets with visors.

Various types of devices have been proposed for helmets. See for example U.S. Pat. No. 4,722,101 to Blower; U.S. Pat. No. 4,891,736 to Gouda; U.S. Pat. No. 5,083,246 to Lambert; U.S. Pat. No. 5,207,500 to Rios et al.; U.S. Pat. No. 5,327,587 to Hurwitz; U.S. Pat. No. 5,408,393 to Becker and U.S. Pat. No. 5,544,027 to Orsano. However, these devices are primarily used for indicating to persons other than the driver a light display such as a turn signal, and the like. None of these devices address the problems presented above.

SUMMARY OF THE INVENTION

The first objective of the present invention is to provide a light indicator device for the visor on a helmet that visibly indicates to a driver when to shift gears.

The second object of this invention is to provide a warning light indicator for a visor on a helmet that visibly indicates to a driver when a gauge warning light such as an oil pressure light, engine temperature light, and the like, comes on.

A preferred embodiment of the light indicator attachment device is used for a helmet with visor being worn by a driver operating a vehicle such as an automobile (race car, and the like) or a motorcycle, and the like. Attached to an interior portion of the visor is an array of light emitting diodes (LEDs). The helmet has wire leads with a plug that attaches to a control box in the vehicle having an internal relay for activating the LEDs, wherein a selected condition in the vehicle turns the LEDs on and off and visibly indicates to the driver the selected condition in the vehicle. Mini U-shaped clamps attach clear flexible tubes holding the LEDs to the interior side of the visor. The control box is hooked to a vehicle battery and to the vehicle dash lights so that the LEDs are powered on regardless of whether the dashlights are on or off. If a 6 volt battery is used, the relay control alternates between a first resistor of approximately 8.2 ohms and approximately 2.4 Watts, and a second resistor of approximately 50 ohms and approximately 2.4 Watts. If a 12 volt battery is used, the relay control alternates between a first resistor of approximately 24 ohms and approximately 4.8 Watts, and a second resistor of approximately 100 ohms and approximately 4.8 Watts. If a 16 volt battery is used, the relay control alternates between a first resistor of approximately 34 ohms and approximately 6.4 Watts, and a second resistor of approximately 150 ohms and approximately 6.4 Watts. The LED array can light up when the selected condition in the vehicle is an rpm (revolutions per minute) gear shift indicator switch that turns on an existing light when the vehicle is to be shifted. Also, the selected condition in the vehicle can be an engine warning light, such as but not limited to an oil pressure sensor light, an engine temperature light, other pressure sensors, monitors, and the like. The LEDs can be identical colored LEDs such as yellow, red, green, and the like, that all simultaneously light up when the selected condition occurs. Also the LED array can include a combination of different LED colored lights, where for example, the rpm (revolutions per minute) gear shift indicator switch light turns on yellow LEDs when the vehicle is to be shifted, and engine warning lights turn on other LEDs such as red ones when engine warning condition(s) occur.

Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1A:
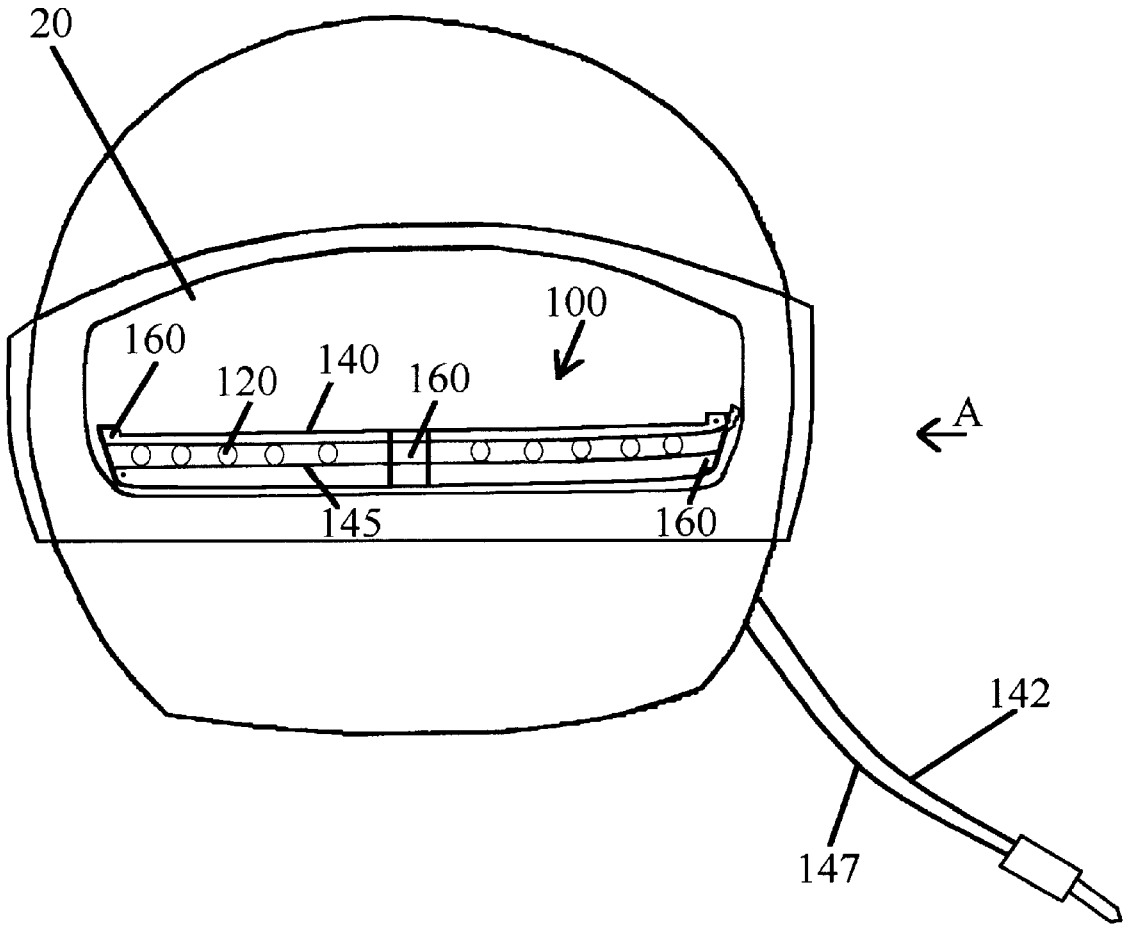
FIG. 1A shows the driver information lights invention on the visor of a helmet
Figure 1B:
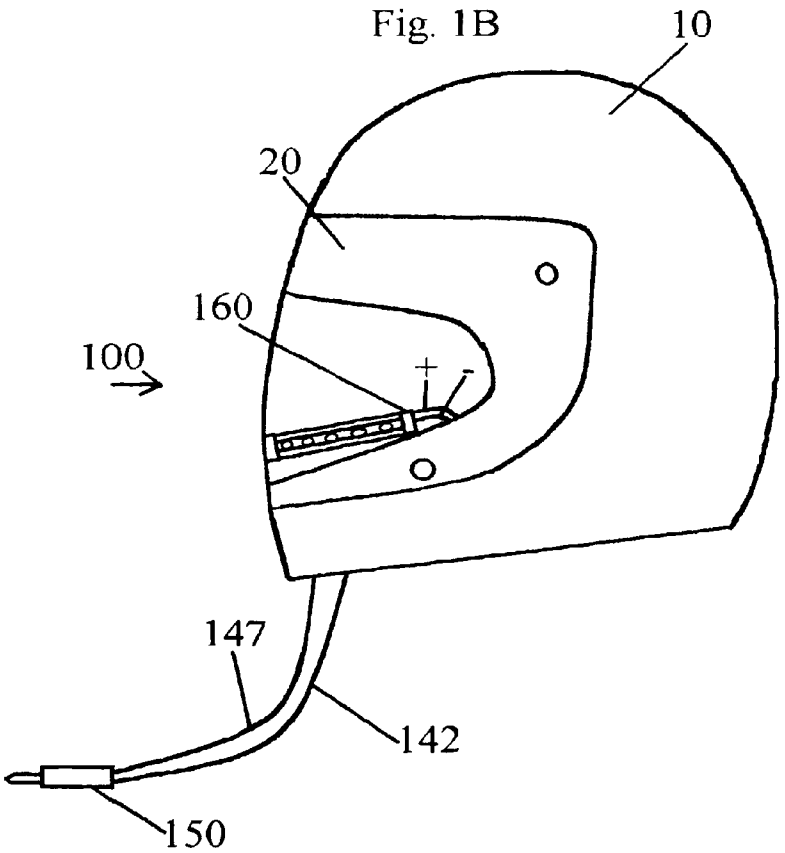
FIG. 1B is a side view of the driver information lights invention of FIG. 1A along arrow A.
Figure 2:
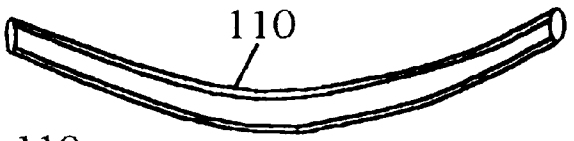
FIG. 2 shows the tube holder for supporting the LEDs used in the embodiment of FIGS. 1A–1B.
Figure 3:
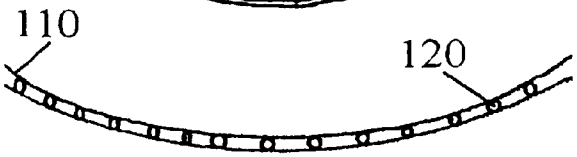
FIG. 3 shows an array of LEDs within the tube holder of FIG. 2.
Figure 4:
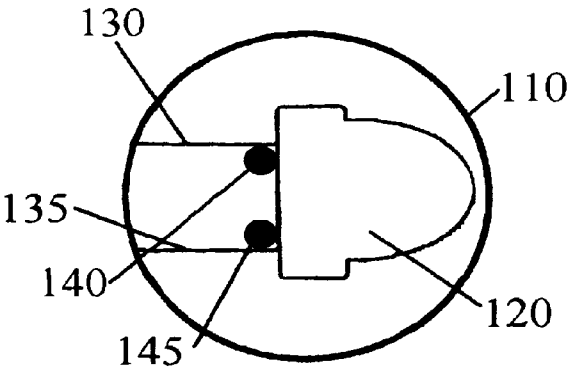
FIG. 4 is an enlarged side view of a single LED in within a tube holder.
Figure 5:
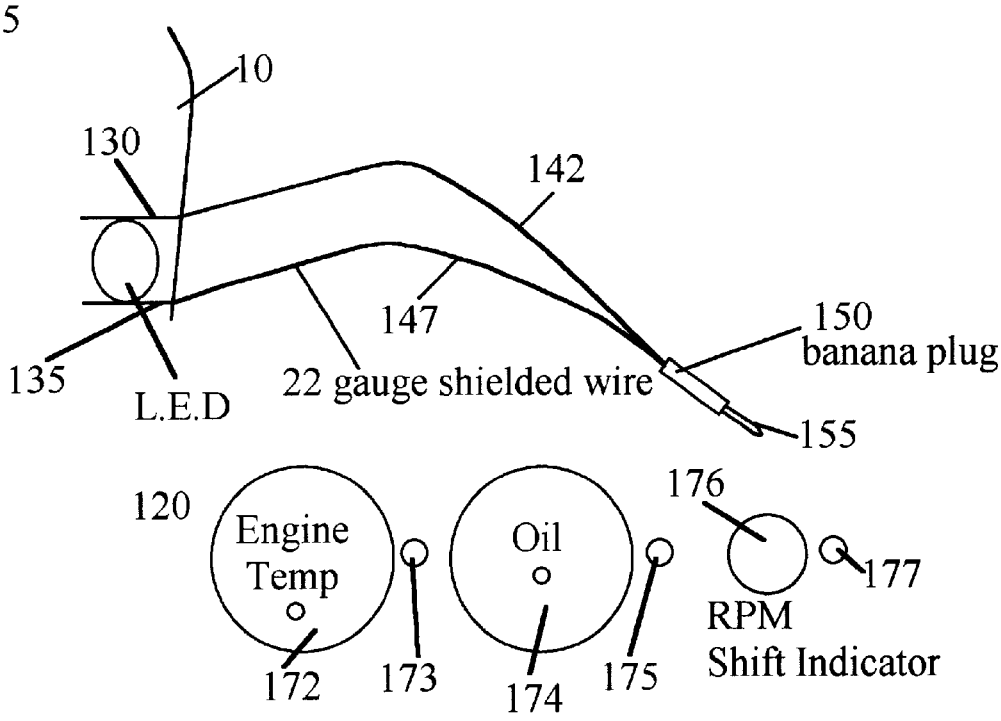
FIG. 5 is an enlarged view of the wire line plug adapter for the embodiment of FIGS. 1A–1B.
Figure 6:
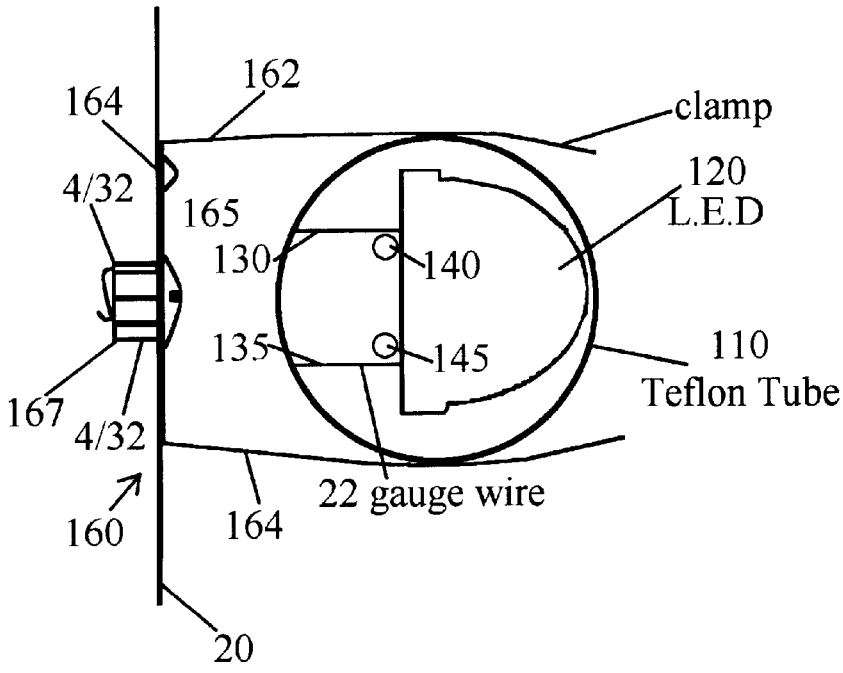
FIG. 6 is an enlarged side view of LED and tube holder of FIG. 4 clamped to the visor.

FIG. 1A shows the driver information lights invention 1 on the visor 20 of a helmet 10. FIG. 1B is a side view of the driver information lights invention 1 of FIG. 1A along arrow A. FIG. 2 shows the tube holder 110 for supporting the LEDs used in the embodiment of FIGS. 1A–1B. FIG. 3 shows an array of LEDs 120 used in the tube holder 110 of FIG. 2. FIG. 4 is an enlarged side view of a single LED 120 within a tube holder 110. FIG. 5 is an enlarged view of the wire line plug adapter 150 for the embodiment 1 of FIGS. 1A–1B. FIG. 6 is an enlarged side view of LED 120 and tube holder 110 of FIG. 4 clamped to the visor 20.

Referring to FIGS. 1A–6, invention 1 includes a Teflon clear plastic tube 110 approximately 5/16" wide by approximately 10" long, with a string of approximately 20 identically colored LED (light emitting diodes), 120, therein. LEDs 120 each have positive (anode) terminal 130 and a negative terminal 135, that are connected in series with adjacent LEDs 120 by solder connections to dual 22 gauge non-coated copper type wire connectors 140, 145 respectively. Each LED 120 can be a 20 milliamp florescent LED that can be chosen from colors such as but not limited to red, green, yellow, and the like. Approximately three U-shaped mini-clamps 160, can be used to secure the tube holder 110 and LED array 120 to the inside of the visor 20. Each clamp 160 can have two inwardly pre-bent legs 162, 164, each being approximately ⅜" long by approximately ½" deep by approximately 0.025" thick. A flat base 164 has similar dimensions of approximately ⅜" long by approximately ½" deep by approximately 0.025" thick. Clamp 160 can be formed from materials such as but not limited to aluminum, galvanized metal, premolded plastic and the like. An approximately ¼ long, approximately ⅛" diameter screw/bolt head 165 can be located on the inside of the visor to secure each clamp 160 to the visor 20 with a nut 167 on the outside of the visor 20. After the clamps 160 are installed on the inside of the visor 20, the tubular holder 110 can be pushed between the legs 162, 164 of each U-shaped clamp 160, which have inwardly pre-bent shapes which wrap about tube holder 110. As previously explained, LEDs 120 connect to lead lines 140, 145 which in turn pass outside of the helmet 10 to dual type 22 gauge Teflon insulated wires 142, 147 to a male RCA banana plug 150, which in turn can connect to a mating female receptacle such as socket 173 electrically connected to an engine temperature gauge 172, socket 175 connected to an oil pressure gauge 174, and a socket connected to an rpm shift indicator light 176.

Figure 7:
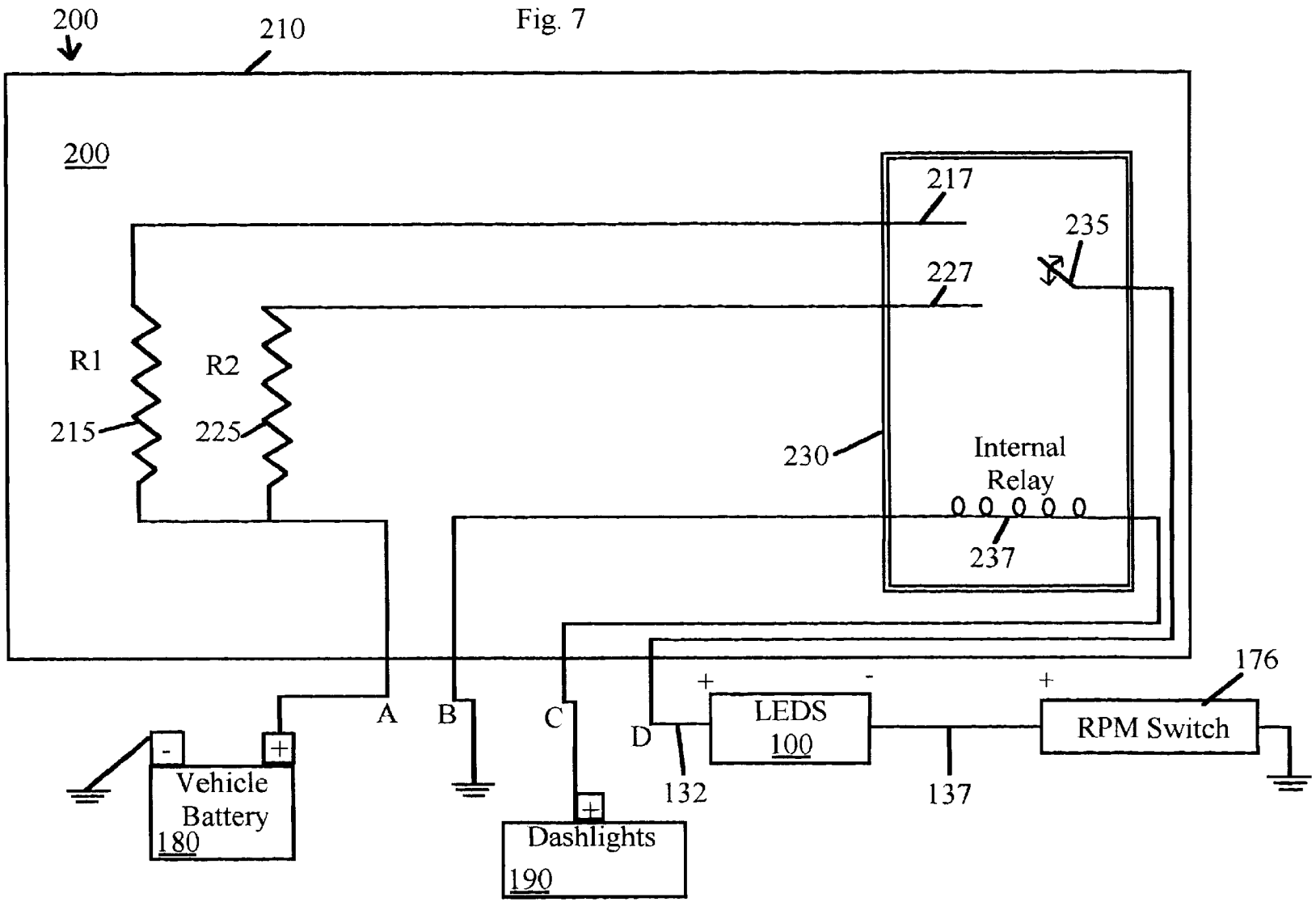
FIG. 7 shows a schematic of using the invention of FIGS. 1A–6 with an rpm shift indicator light.

FIG. 7 shows a schematic 200 of using the invention 100 of FIGS. 1A–6 with an rpm shift indicator light 176. Referring to FIG. 7, the control box 200 can be formed from injection molded plastic, and the like, with four exterior connection terminals A, B, C, and D. Vehicle battery 180 has a chassis grounded connection off the negative terminal. Terminal A of control box 200, receives positive voltage from the negative terminal of the battery 180. Terminal A connects to two resistors, R1, 215, and R2, 225, respectively. TABLE 1 gives the various sizes of resistors R1, R2, dependent upon the size of the battery used in the vehicle.

TABLE 1

| BATTERY | R1(Ohms) | R1(Watts) | R2(Ohms) | R2(Wattts) |
|---|---|---|---|---|
| 6 Volts | 8.2 | 2.4 | 50 | 2.4 |
| 12 Volts | 24 | 4.8 | 100 | 4.8 |
| 16 Volts | 34 | 6.4 | 150 | 6.4 |

Internal control box relay 230 can be a 30 amp 5 outlet automotive relay, which has an internal switch 235 which switches between contacts 217 and 227, respectively. Coil 237 makes the relay switch from one circuit to another so that when a voltage is applied from lead C and a ground from lead B, there is a magnetic field created that pulls the switch tab 235 off the 217 contact and connects to the 227 contact. Terminal B of control box 200 is chassis grounded, and Terminal C receives a positive voltage from the vehicle dash lights 190, and Terminal D connects to the positive voltage of the LED array 100 in helmet 1. The negative terminal of LED array 100 connects to rpm shift indicator switch 176 which also connects to chassis ground. As previously explained rpm shift indicator switch 176 already exists on many race cars, and activates an existing light to indicate to the driver when to shift into the next gear. The operation of schematic 200 will now be described.

Referring to FIG. 7, with a vehicle (not shown) running, the positive voltage from vehicle battery 180 runs into Terminal A of control box 200 to either Resistor R1 215, or R2 225 to internal relay 230. Relay 230 is activated by the positive voltage coming through Terminal C from the vehicle dashlights 190 which determines which resistor R1, R2 allows voltage from Terminal A to flow through. If dash lights 190 are not powered on, then R1 215 would be chosen to be connected to helmet lights 100. If dash lights 190 are powered on, then R2 225 is chosen by relay 230. Thus, Terminal C receiving voltage determines which resistor R1, R2 passes voltage. Within control box 200, voltage passes to Terminal D and positive wire 132 to LED array 100, of which the negative wire 137 to rpm activated switch 176. The shift indicator rpm activated switch 176 will provide a chassis ground to the LED array 100 when a predetermined engine rpm is achieved, thus allowing the total circuit 200 to connect and light up all LEDs simultaneously. For example, if rpm switch indicates a shift light at 1500 rpm, the LEDs 100 will light up at 1500 rpm and so forth.

Figure 8:
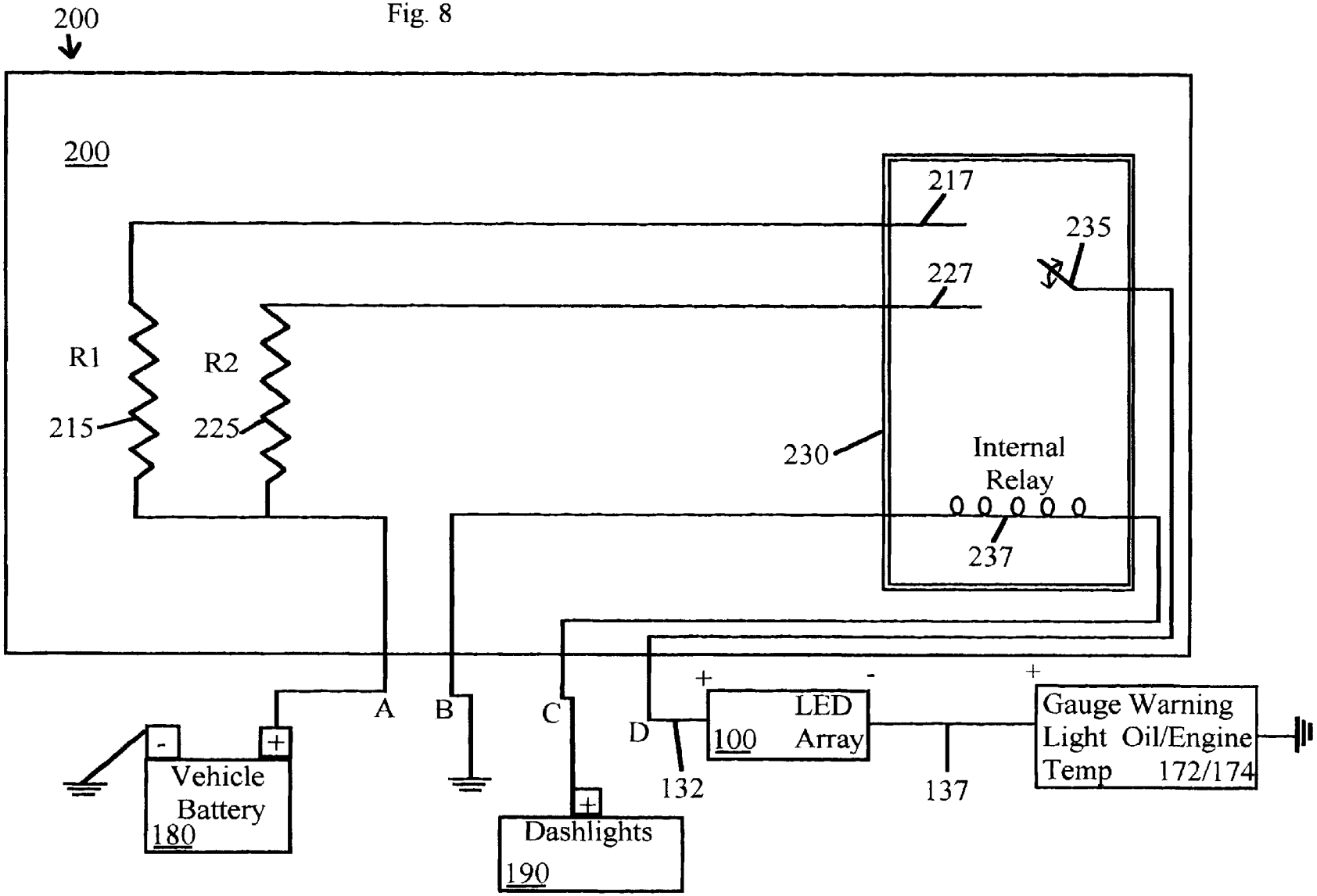
FIG. 8 shows a schematic of using the invention of FIGS. 1A–6 with warning light gauges.

FIG. 8 shows a modified schematic 200' of using the invention of FIGS. 1A–6 with warning light gauges 172, 174. Embodiment 200' shows preferred connections for using the invention for a warning system to inform the driver of mechanical malfunctions in the vehicle such as high engine temperature 172, low oil pressure 174, and the like. The basic difference between embodiments 200 and 200', has the engine warning light indicator 172/174 substituted for the rpm switch 176. Similar to the previous embodiment, if a warning light 172/174 turns on, all the LEDs 100 simultaneously activate.

While the preferred embodiments describe connecting the invention to either the rpm shift indicator switch or to engine warning lights, the invention can be used when combining light indicators for both vehicle warning lights and shift indicator lights. For example, the LED array can include 10 yellow LEDs that light up when the rpm shift indicator light turns on. Interspersed between each of the yellow LEDs can be 10 red LEDs which only light up when a vehicle warning light activates.

Although the preferred embodiments show attaching the tube of LEDs to the interior of the visor, the LEDs can be attached in other areas visible to the driver, such as the outside of the visor, or in helmets having chin protecting walls then on the inside of the helmet chin protecting wall.

Although the preferred embodiments describe using identical colored lights in the LED array, the invention can be used with other colored lights such as green, red, blue, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A light indicator attachment device for helmets, comprising in combination:

a helmet having a viewing window being worn by a driver operating a vehicle;

a longitudinal array of light emitting means directly attached to the window for emitting light to the driver; and means for activating the array of light emitting means on occurrence of a selected threshold value of a selected condition in the vehicle, wherein the selected condition in the vehicle turns a portion of the longitudinal array of light emitting means on and off and visibly indicates to the driver the selected condition in the vehicle.

2. The light indicator attachment device of claim 1, wherein the viewing window includes:

a visor.

3. The light indicator attachment device of claim 2, further comprising:

clamp means for attaching the array of the light emitting means to the visor.

4. The light indicator attachment device of claim 3, wherein the longitudinal array of light emitting means includes:

LEDs (light emitting diodes) having at least two being identically colored.

5. The light indicator attachment device of claim 4, wherein the longitudinal array of light emitting means includes:

a flexible tubular holder for supporting the LEDs therein, the tubular holder being inserted within the clamp means.

6. The light indicator attachment device of claim 1, wherein the longitudinal array of light emitting means includes:

LEDs (light emitting diodes) having at least two being identically colored.

7. The light indicator attachment device of claim 6, wherein the longitudinal array of light emitting means includes:

a flexible tubular holder for supporting the LEDs therein, the tubular holder being attached to the viewing window.

8. The light indicator attachment of claim 1, wherein the means for activating the light emitting means includes:

a relay control for allowing the array of the light emitting means to activate whether or not dashlights on the vehicle are operating.

9. The light indicator attachment device of claim 8, further comprising:

a 6 volt battery, and the relay control includes a relay switch alternatively connected between a first resistor of approximately 8.2 ohms, and a second resistor of approximately 50 ohms.

10. The light indicator attachment device of claim 8, further comprising:

a 12 volt battery, and the relay control includes a relay switch alternatively connected between a first resistor of approximately 24 ohms, and a second resistor of approximately 100 ohms.

11. The light indicator attachment device of claim 8, further comprising:

a 16 volt battery, and the relay control includes a relay switch alternatively connected between a first resistor of approximately 34 ohms, and a second resistor of approximately 150 ohms.

12. The light indicator attachment device of claim 1, wherein the selected condition in the vehicle includes:

an rpm (revolutions per minute) gear shift indicator switch, wherein the switch turns on a shift light when the vehicle is to be shifted.

13. The light indicator attachment device of claim 1, wherein the selected condition in the vehicle includes: an engine warning light.

14. The light indicator attachment device of claim 13, wherein the engine warning light includes: an oil pressure sensor light.

15. The light indicator attachment device of claim 13, wherein the engine warning light includes: an engine temperature light.

16. The light indicator attachment device of claim 1, wherein the selected condition in the vehicle includes:

an rpm (revolutions per minute) gear shift indicator switch light, wherein a first set of the light emitting means turn on when the vehicle is to be shifted; and an engine warning light, wherein a second set of the light emitting means turn on when an engine warning condition exists.

17. The light indicator attachment device of claim 1, wherein the vehicle includes:

an automobile.

18. The light indicator attachment device of claim 1, wherein the vehicle includes:

a motorcycle.

19. An attachment device for visually indicating selected operating conditions of a vehicle to a driver, comprising in combination:

a helmet having a viewing window, the helmet being worn by a driver of a vehicle;

a longitudinal light source directly attached across the viewing window, the longitudinal light source for emitting light to the driver wearing the helmet; and means for turning the longitudinal light source on and off at a selected threshold value based on a selected operating condition of the vehicle, the selected operating condition being chosen from at least one of: an rpm (revolutions per minute) gear shift indicator switch which turns on the longitudinal light source when the vehicle is to be shifted, an engine warning switch which turns on the longitudinal light source for an engine warning condition, an oil pressure switch which turns on the longitudinal light source at a selected pressure, and an engine temperature switch which turns on the longitudinal light source at a selected temperature.

20. The attachment device of claim 19, wherein the longitudinal light source includes:

an array of LEDs (light emitting diodes) at least two of which are identically colored.

* * * * *